US011801615B2

(12) United States Patent
Wertzberger

(10) Patent No.: US 11,801,615 B2
(45) Date of Patent: Oct. 31, 2023

(54) METHOD AND DEVICE FOR REMOVAL OF ITEMS FROM A MOLD

(71) Applicant: Kalman Wertzberger, Brooklyn, NY (US)

(72) Inventor: Kalman Wertzberger, Brooklyn, NY (US)

( * ) Notice: Subject to any disclaimer, the term of this patent is extended or adjusted under 35 U.S.C. 154(b) by 942 days.

(21) Appl. No.: 16/289,849

(22) Filed: Mar. 1, 2019

(65) Prior Publication Data

US 2019/0193297 A1 Jun. 27, 2019

Related U.S. Application Data

(63) Continuation-in-part of application No. 16/032,342, filed on Jul. 11, 2018, now abandoned.

(60) Provisional application No. 62/533,424, filed on Jul. 17, 2017.

(51) Int. Cl.

| | |
|---|---|
| ***B28B 7/12*** | (2006.01) |
| ***B28B 7/34*** | (2006.01) |
| ***B28B 7/00*** | (2006.01) |
| ***B28B 13/06*** | (2006.01) |

(52) U.S. Cl.

CPC ..... *B28B 7/12* (2013.01); *B28B 7/0008* (2013.01); *B28B 7/0094* (2013.01); *B28B 7/348* (2013.01); *B28B 13/065* (2013.01)

(58) Field of Classification Search

CPC ..... B28B 7/12; B28B 7/0008; B28B 7/0094; B28B 7/348; B28B 13/065

See application file for complete search history.

(56) References Cited

U.S. PATENT DOCUMENTS 4,050,666 A * 9/1977 Van Tichelt ..... B28B 7/10 425/444

9,849,609 B2 * 12/2017 Merli ..... B28B 7/007

* cited by examiner

*Primary Examiner* — Monica A Huson
*Assistant Examiner* — Kelsey C Grace
(74) *Attorney, Agent, or Firm* — Israel Nissenbaum; Yitzy Nissenbaum

(57) ABSTRACT

A method and device for removal of a molded sample from a mold with minimal or no damage to the molded sample. The device includes a drill configured for perforating a wall of the mold with the formation of a through aperture, a shroud passageway through or adjacent the drill, and a passageway from a source for pressurized fluid leading to the shroud passageway. The shroud passageway is configured whereby fluid such as air is applied therethrough simultaneously with perforation operation of the drill. Air directed through the aperture is pressurized and comes into effective contact with the molded sample whereby the molded sample is prevented from being more than minimally contacted with the drill and caused to be removed from the mold.

12 Claims, 5 Drawing Sheets

METHOD AND DEVICE FOR REMOVAL OF ITEMS FROM A MOLD

This application is a non-provisional application with priority from provisional application 62/533,424, filed Jul. 17, 2017 and is a continuation in part of non-provisional application Ser. No. 16/032,342, filed Jul. 17, 2018.

FIELD OF THE INVENTION

This invention relates to device and methods used to remove items from molds in which they have been formed and particularly concrete samples used for compression tests.

BACKGROUND

It is a general legal safety requirement that with many constructions involving concrete mixtures, samples of the concrete mixture need to be made on a periodic basis for testing including for compression strength. Accordingly, it is a common practice, when such testing is required, for small sample molds, generally of plastic, to be manufactured and filled with the concrete mixture to be used. The concrete is removed from the mold after reaching its representative setting for the requisite testing. The samples need to be removed without or with minimal damage, from the mold. However, the concrete tends to set and effectively adhere against the inner walls of the molds with a vacuum resistance (not necessarily a chemical bond) formed during removal, thereby making them difficult to remove without or with minimal damage.

A common method of mold removal is the perforation of the mold base, such as with a drill or a nail. This is coupled with the subsequent application, to the perforation, after removal of the perforating drill or nail, of a fluid such as gas, and commonly air, with sufficient pressure to cause the vacuum between the concrete with the mold to break. The concrete sample is thereby enabled to be lifted out of the mold by the fluid such as with air pressure or for the mold base to be forced away from the concrete sample. This procedure is however tedious and is subject to possible sample damage by the drill or nail coming into contact with the concrete. A single forced penetration, particularly of an internal non-visible nature, such as when a concrete cylinder is still within the mold, may cause a detrimental propagating crack to be formed with resultant skewed or inaccurate compression readings.

SUMMARY OF THE INVENTION

It is accordingly an object of the invention to provide a method and device that effects removal of concrete or other materials from molds or the molds from the contained materials in a simple or even a single operation, while serving to help protect the molded object from possible damage resulting from the removal.

It is a further object to provide the method and device wherein the removal may be effected in any selected direction and to provide appropriate jigs for use in the removal operations, as desired or needed.

Generally the present invention comprises a method and device for use in the method for removal of molded samples, particularly of concrete, from open ended (or separately capped or with a hinged lid) mold receptacles, commonly of cylindrical configuration with a closed end, and comprised of a readily perforable material such as plastic. The method comprises the step of perforating the closed end or base of the mold receptacle with a fluted drill bit while simultaneously forcing fluid, such as air, around and/or through the drill bit; whereby, upon perforation of the closed end or base of the mold receptacle, the fluid immediately passes through the perforation and effectively impinges on a surface of the sample (or on movable surface elements such as sheets of plastic or paper adjacent the surface of the molded sample) within the mold receptacle with sufficient pressurized force to move the sample away from the advancing drill, with the drill bit minimally or never contacting the sample. Continued introduction of the fluid serves to either force the sample out of the mold receptacle or the mold receptacle off the sample depending on orientation of the open end of the mold receptacle. Though the fluid may be pressurized along its entire path, the fluid is pressurized at least within the perforation and between the mold sample and the mold wall to effect the forced removal.

A device for sample removal as used in effecting the above removal method, with removal of the molded sample from its mold receptacle, with minimal or no damage to the molded sample, comprises:

a) a drilling structure comprising a drive mechanism and a drill bit configured to essentially perforate a mold container material at its base and further configured to simultaneously permit a fluid flow to pass through a drilled perforation in the container base. To avoid or minimize damaging the molded sample, the drill bit is, in one embodiment, provided with a relatively flat tip with one or more circumferentially positioned protrusions which, when rotated, provides an aperture cutting element;

b) an enclosing or circumferential shroud or passageway positioned at least around the perforating tip of the drill bit and configured to provide a directed fluid through the perforating tip of the drill bit to become pressurized within the mold container and to effectively impinge upon a base of the sample within the mold ahead of the drill bit; and c) a fluid introduction conduit extending between a fluid source and the shroud or passageway as a directed source for the fluid flow such as air.

d) Optionally, depending on orientation of the mold with contained sample and the drilling structure, a jig is provided to hold the mold with contained sample during a sample removal procedure. The jig is configured to snugly enclosed the mold receptacle with testing sample contents therein, with the jig having a support such as an internal peripheral lip to support the closed end of the mold receptacle while leaving open an area for perforation; jig structures and elements in different orientations are dictated by the different orientations, such as the effect of gravity.

In the above steps and elements, the shroud or passageway may be comprised of a portion of the drill tip itself such as an opening in the drill head.

Other objects, features and advantages will become more evident from the following discussion and drawings in which:

SHORT DESCRIPTION OF THE DRAWINGS

DETAILED DESCRIPTION OF THE INVENTION AND DRAWINGS

Figure 1:
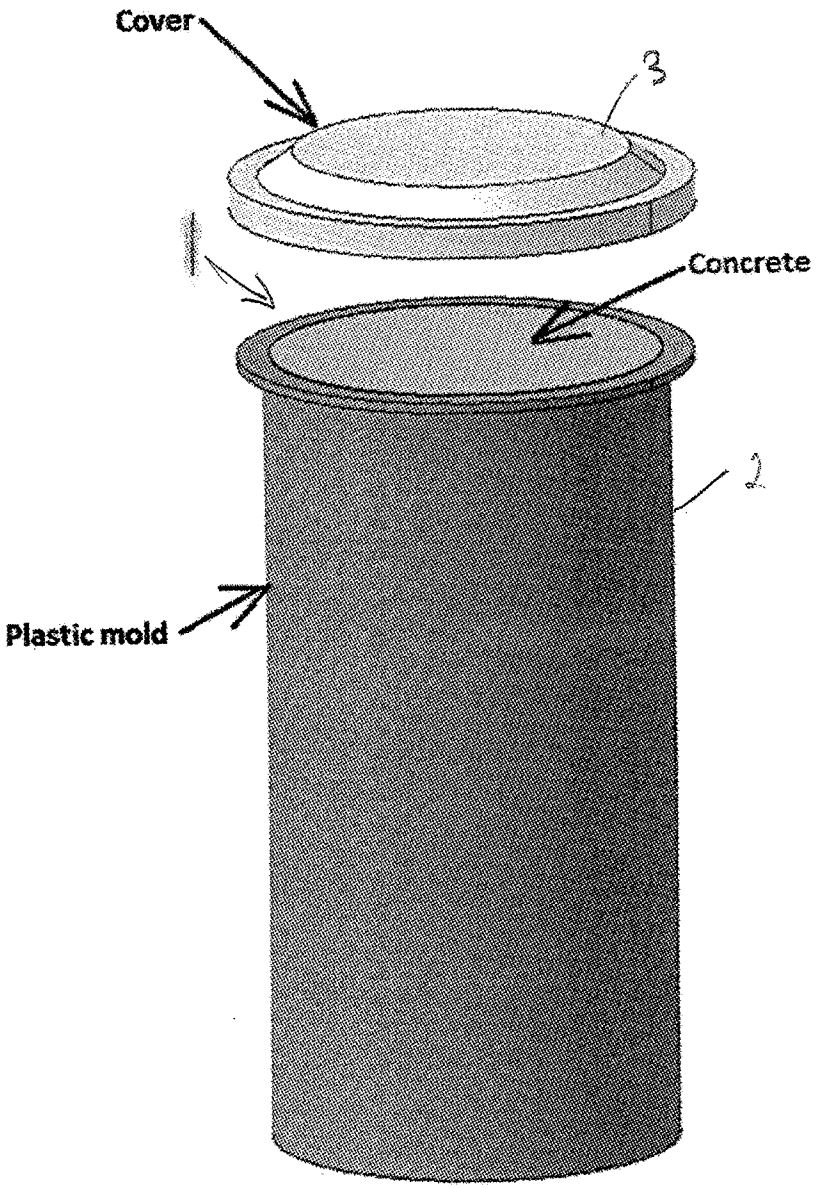
FIG. 1 depicts a typical concrete mold sample contained with a plastic mold receptacle.

In a further embodiment, the drilling structure has a gas retention and directing enclosure (shroud or passageway) around the drill bit with an inlet for fluid and most commonly gas, such as air from a source. Alternatively, the drill bit has a drill tip with an integrated passageway. The air is directed through the shroud or passageway and into the mold interior, after wall perforation, where it becomes pressurized under the pent up conditions. Pressurization is not necessarily required and the air is not necessarily even hermetically retained by an enclosure or shroud prior to ingress into the mold interior. Pressurization is provided within the mold interior and between the mold sample and the mold wall. To facilitate such pressurization, in an embodiment, an engaging lip of the shroud or passageway seals with the container base, though not necessarily hermetically, in order to retain build up sufficient gas pressure in the mold receptacle to force the mold specimen out of the mold receptacle.

In order to permit the influx of gas, simultaneously with the drilling, the drill is provided with passages such as flutes to enable gas or air to travel around the drill and come from the tip of the drill through the perforation, into the mold receptacle and into contact with the base of the concrete sample once the drill has perforated a wall (usually the base) of the mold. If the mold, with contained sample is inverted, the base wall is on top with mold being held while the sample is pushed out of the bottom opening. Perforation is generally in a wall of the mold receptacle opposite an opening of the receptacle.

Continued pent up continued supply of the gas or air within the mold receptacle builds up pressurization of the gas or air within the mold receptacle against the mold sample. The simultaneous application of drill and gas pressurization within the mold receptacle serves to prevent the drill from over-travel and excessive contact with the mold sample. As the drill extends past the base of the mold, the mold sample is lifted or pushed away from contact with the drill.

As part of the method, if necessary, gas pressure sufficient to lift the specimen out of the mold is determined prior to the drilling. The shroud enclosure is sufficient to resist the gas pressure and to maintain sufficient gas pressure to force the molded sample out of the mold at a rate of about several seconds. Prolonged extraction is not desired in order to facilitate specimen removal for testing particularly if there are numerous samples. Nevertheless a slow rate of removal is encompassed herein. It is, of course, not desirable that the force of the gas pressure be overly excessive whereby the specimens rapidly shoot out of the mold unless checked.

The drill structure may be in an upward orientation with the mold sample in a jig above the drilling structure. Perforation is in an upward direction and the mold sample is lifted from the mold receptacle by the applied air or fluid pressure. Alternatively, the mold is placed with the open end facing down and the mold base facing up. In this orientation the drilling structure is configured similar to a drill press with the air pressure serving to raise the mold receptacle upwardly with removal of the mold receptacle from the sample. In this latter embodiment less pressure is required for the removal based on the relative weights of the concrete sample and plastic receptacle. Greater care is however required to ensure that the downward movement of the drill bit does not overtake the air pressure removal of the mold receptacle with inadvertent damage to the sample by the drill bit.

Figure 2:
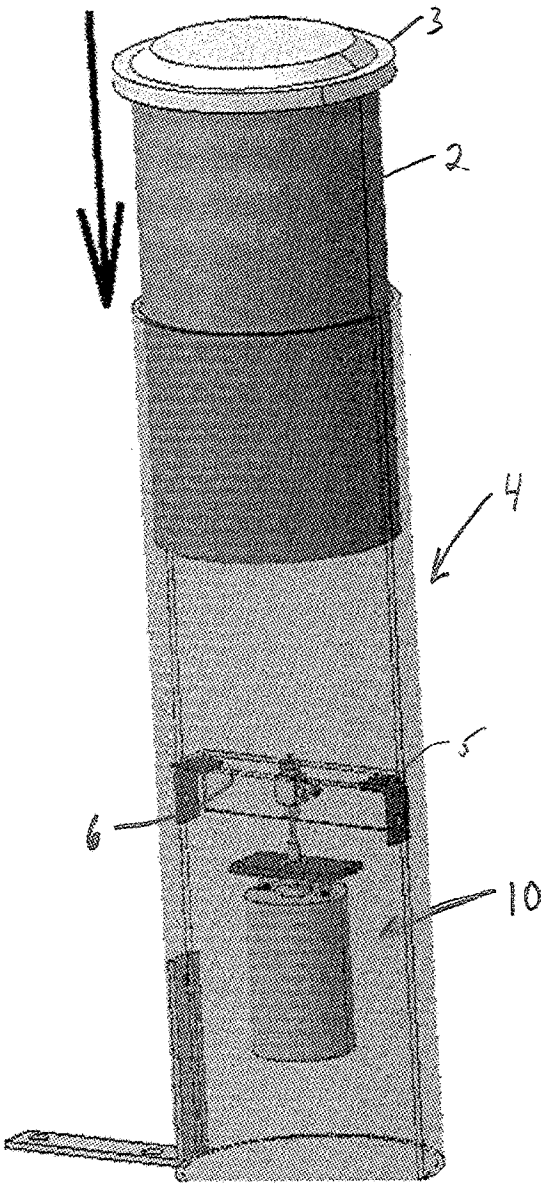
FIG. 2 depicts the mold sample of FIG. 1 as being inserted within a jig structure having the drill structure of the invention.
Figure 3:
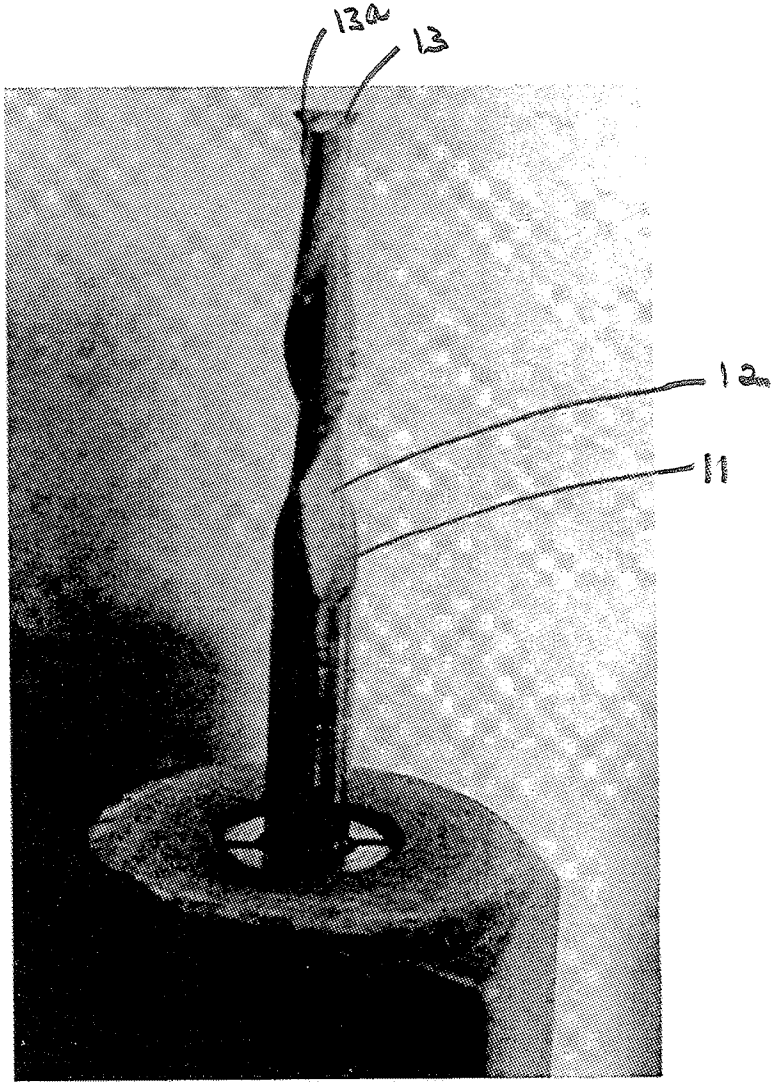
FIG. 3 is an enlarged view of the drill bit with flat head as used in the drill structure.

With respect to the drawings, in FIG. 1, a molded concrete sample 1 is shown, as contained within cylindrical plastic mold container 2 and capped with loosely fitting cap 3. In FIG. 2, the mold 2 with contained concrete sample 1 is snugly seated within a cylindrical tube jig 4 having an internal retaining lip 5. A drill structure 10 is retained slightly below the retaining lip 5 via cross bar 6. As shown in FIG. 3, a drill bit 11 having extending flutes 12 and a flat cutting head 13 is used to perforate the mold receptacle at its base. Cutting head 13 is provided with slight peripheral protrusion 13*a* which minimizes any damaging extension area while providing a rotatable perforation element. The protrusion is angled so as to cause pressurized air to more easily flow between the mold sample and the adjacent mold receptacle wall in order to facilitate initiating separation of the mold sample from the adjacent receptacle wall.

Figure 4:
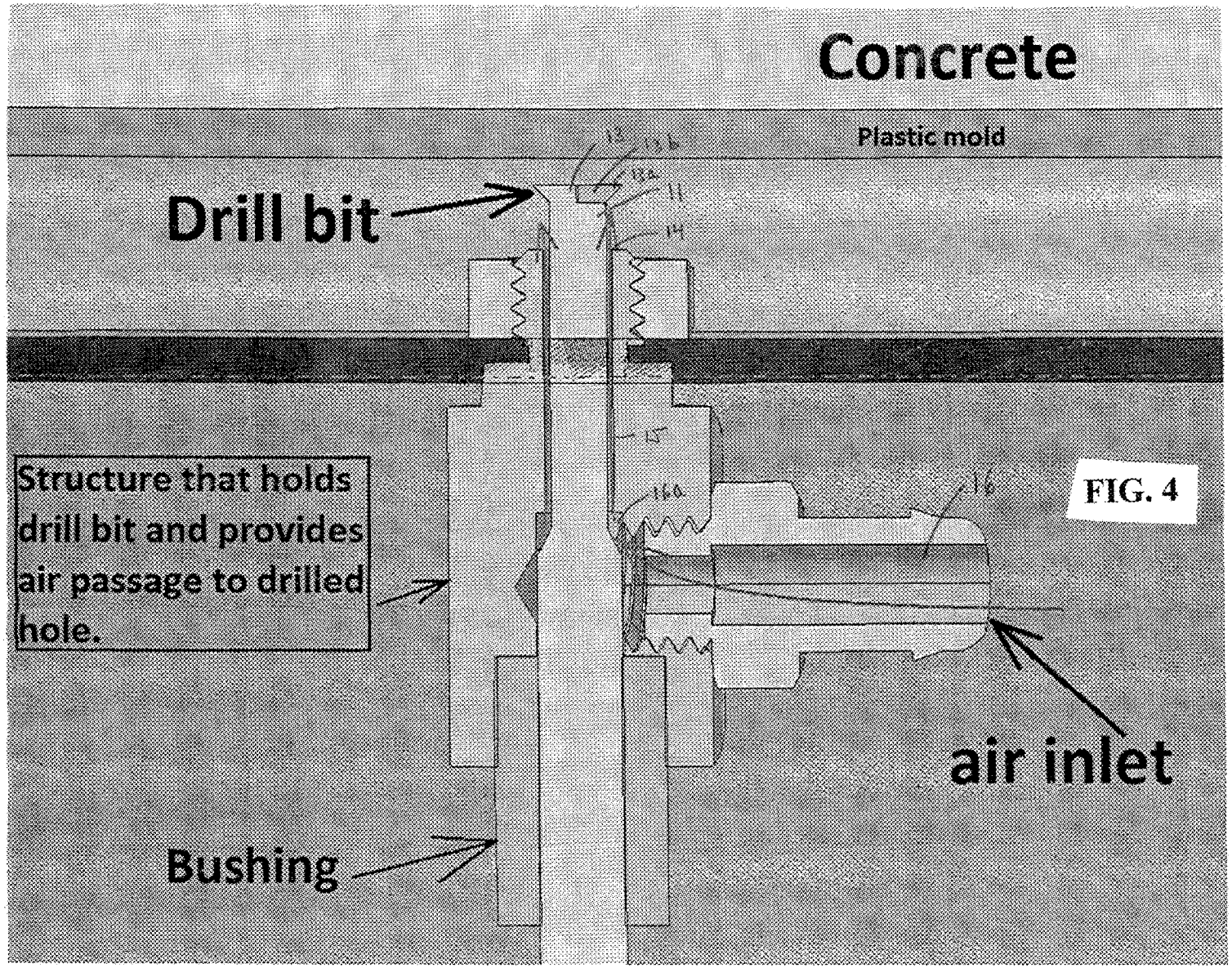
FIG. 4 is a side cross sectioned view of the operative portion of the drill structure with drill bit and air inlet and conduits (shroud or passageway elements)

FIG. 4, shows, in cross section, drill bit 11 contained with shroud 14 and spaced therefrom by an air passage 15. Air inlet 16 feeds into the air passage 15 at 16*a* whereby pressurized air is able to pass through the air passage around drill bit 11 and the air pressure is also directed through the flutes 12 an out of space 13*b* at the drill cutting head 13.

Figure 5:
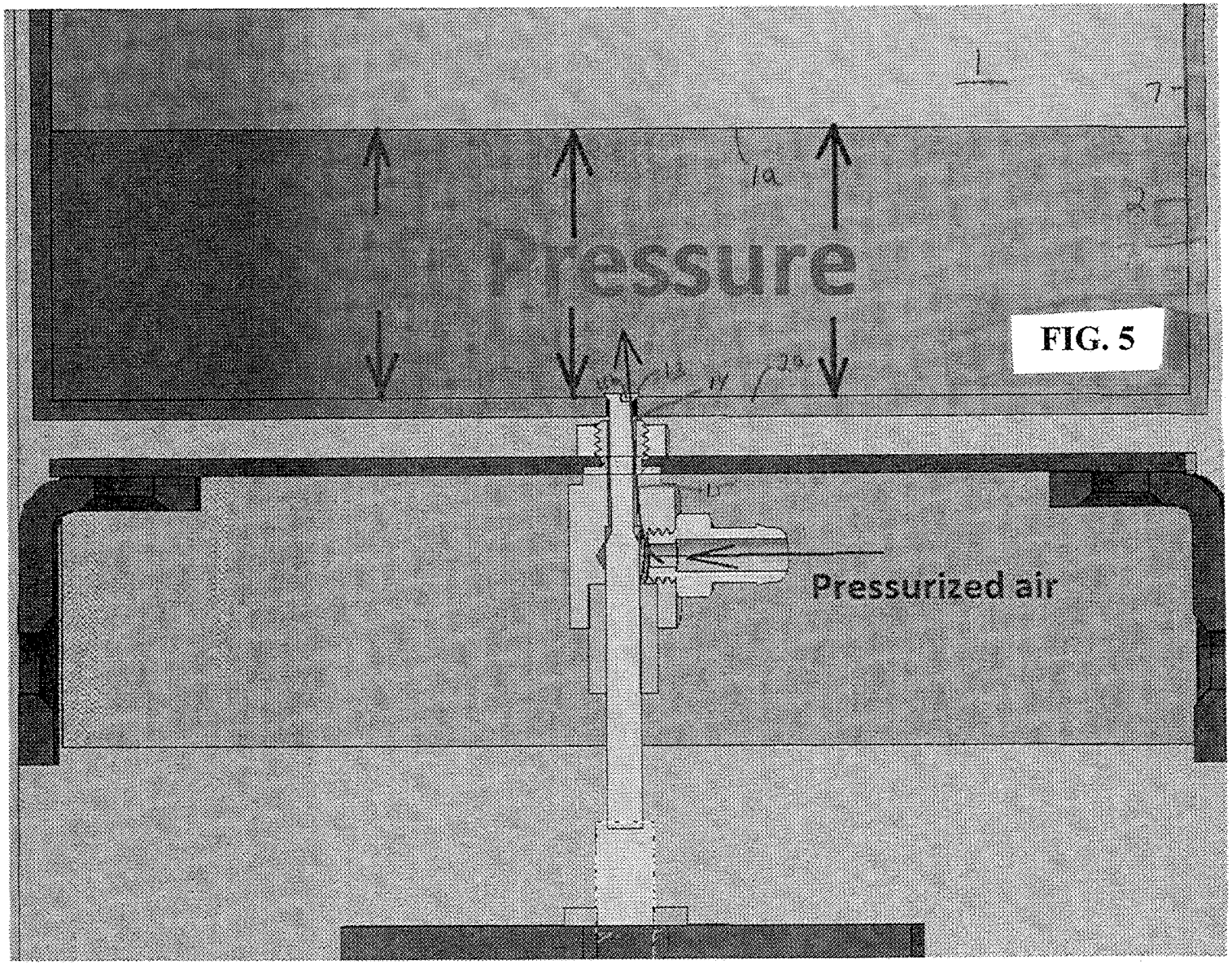
FIG. 5, depicts the drill bit with mold base perforation and air pressure influx for sample movement relative to the mold receptacle.

FIG. 5 shows the effect of the air pressure exiting at the drill head 13 in impinging on the base 1*a* of sample 1 after the drill head 13 has cut through the base 2*a* of mold receptacle 2. The snug fit interface 7 between the mold sample 1, as molded within the receptacle 2, provides sufficient frictional resistance whereby the sample is able to be controllable removed from the mold sample by air pressure alone and without detrimental contact with a drill, nail, awl or any perforating device. The snug fit also serves to minimize air build-up leakage whereby pressurization of the air is facilitated. The shroud or passageway which direct the air to be pressurized within the mold interior is shown in the figures as passages 13*b*, 14, and 15.

It is understood that the above example and description is only illustrative of the invention and that changes in structure and materials including materials being molded and mold shape are possible without departing from the invention as defined by the following claims.

What is claimed is:

1. A device for causing removal of a molded sample from a mold container having a closed end, with minimal damage to the molded sample comprising:

a) a drill separate from the mold container configured for perforating the closed end of the mold container with the formation of a through aperture, b) a surrounding shroud peripherally encircling the drill, which does not impede perforation operation by the drill, and c) a source for pressurized fluid, wherein the shroud is attached to the pressurized fluid source as a conduit whereby pressurized fluid is applied through the shroud and peripheral to the drill simultaneously with perforation operation of the drill and the pressurized fluid is directed through the aperture into direct contact with the molded sample whereby the molded sample is caused to be removed or separated from and made removable from the mold container by direct forceful contact with the pressurized fluid, with substantial minimization of the drill from contacting the molded sample.

2. The device of claim 1, wherein the molded sample is comprised of concrete for compression testing and wherein the pressurized fluid is air and the shroud is configured to withstand a pressure sufficient to remove the molded sample from the mold container.

3. A device for causing removal of a molded sample from a mold container having a closed end with minimal damage to the molded sample comprising:

a) a drill configured for perforating the closed end of the mold container with the formation of a through aperture, b) a surrounding shroud peripherally encircling the drill, which does not impede perforation operation by the drill, and c) a source for pressurized fluid, wherein the shroud is attached to the pressurized fluid source as a conduit whereby pressurized fluid is applied through the shroud and peripheral to the drill simultaneously with perforation operation of the drill and directed through the aperture into direct contact with the molded sample whereby the molded sample is caused to be removed or separated from and made removable from the mold container with substantial prevention of the drill from contact with the molded sample, wherein the drill is fluted and is configured to comprise at least part of the fluid conduit shroud.

4. The device of claim 3, wherein the drill is perforated and is configured to comprise at least part of the conduit shroud, with inclusion of a longitudinal perforation to connect with the directed pressurized fluid to a perforating end of the drill.

5. The device of claim 1, wherein the drill comprises a flat surface in contact with the closed end of the mold container and wherein the flat surface comprises a protrusion which serves, with rotation, to effect the perforation of the closed end with the protrusion being of minimal height whereby it minimally contacts the mold sample after perforation of the closed end of the mold container.

6. The device of claim 5, wherein the protrusion is angled whereby the perforation permits an enhanced flow of fluid between the mold sample and the mold container.

7. The device of claim 1, wherein the conduit shroud comprises a lip which is configured to contact an outer surface of the closed end peripheral to the perforation to effect pressure retention of the pressurized fluid.

8. A method for removal of a molded sample from a mold container having a closed end with minimal damage to the molded sample comprising the steps of:

a. providing a drill separate from the mold container for perforation of a base wall of the mold with a through aperture;

b. encircling the drill with a conduit shroud whereby a pressurized fluid is able to be directed through the shroud and through the through aperture into contact with a base of the molded sample;

c. simultaneously drilling and perforating the base wall and directing a pressurized fluid through the conduit shroud into direct contact with the base of the molded sample whereby the molded sample is moved away from contact with the drill after the base all of the mold is perforated, wherein the molded sample is comprised of concrete for compression testing and wherein the pressurized fluid is directed as air and the conduit shroud is configured to withstand a pressure sufficient to remove or dislodge the molded sample from the mold.

9. The method of claim 8, wherein the drill is provided with a flat surface in contact with the base wall of the mold and wherein the flat surface is further provided with a protrusion which serves, with rotation, to effect the perforation of the base wall.

10. The method of claim 9, wherein the provided protrusion is angled whereby the perforation perforates the base wall with an angle which permits an enhanced flow of fluid between the mold sample and the mold.

11. The method of claim 8, wherein the conduit shroud comprises a lip which is configured to contact an outer surface of the base wall peripheral to the perforation to effect pressure retention of the pressurized fluid.

12. The device of claim 1, wherein the drill is configured to rotationally perforate the closed end of the mold container.

* * * * *